US009905142B2

(12) United States Patent
Kaplan et al.

(10) Patent No.: US 9,905,142 B2
(45) Date of Patent: Feb. 27, 2018

(54) UNI-DIRECTIONAL AND MULTI-DIRECTIONAL INTERCHANGEABLE SCREEN

(71) Applicant: International Business Machines Corporation, Armonk, NY (US)

(72) Inventors: Philippe Kaplan, Le Rouret (FR); Georges-Henri Moll, Villeneuve-Loubet (FR); Xavier A. Nodet, Antibes (FR); Olivier Oudot, Vallauris (FR)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 15/008,674

(22) Filed: Jan. 28, 2016

(65) Prior Publication Data

US 2017/0221398 A1 Aug. 3, 2017

(51) Int. Cl.
*G09G 3/00* (2006.01)
*G09G 3/34* (2006.01)

(52) U.S. Cl.
CPC ..... *G09G 3/003* (2013.01); *G09G 3/3406* (2013.01); *G09G 2320/0606* (2013.01); *G09G 2320/068* (2013.01); *G09G 2320/08* (2013.01); *G09G 2358/00* (2013.01)

(58) Field of Classification Search
None
See application file for complete search history.

(56) References Cited

U.S. PATENT DOCUMENTS 5,956,107 A * 9/1999 Hashimoto ..... G01D 11/28 349/62
6,834,968 B2 12/2004 Peatross et al.
7,580,186 B2 8/2009 Mather et al.
7,973,749 B2 7/2011 Uehara et al.
2008/0180654 A1* 7/2008 Bathiche ..... G06F 3/0238 356/51

(Continued)

FOREIGN PATENT DOCUMENTS

CN 104654132 A 5/2015
EP 2362373 A1 8/2011

OTHER PUBLICATIONS

Wollman, "Apple patent application reveals an LCD with switchable, privacy-protecting viewing angles", May 22, 2011, pp. 1-3, <http://www.engadget.com/2011/05/22/apple-patent-application-reveals-an-lcd-with-switchable-privacy/>.

(Continued)

*Primary Examiner* — Chad Dicke
(74) *Attorney, Agent, or Firm* — Alexa L. Ashworth; Brian M. Restauro

(57) ABSTRACT

Embodiments of the present invention provide a method, computer program product, and system for a uni-directional and multi-directional interchangeable screen. The system includes a screen and an opaque micro-tube connected at one end to the screen. A bottom backlight is connected to the other end of the opaque micro-tube and a top backlight is connected to the screen. The system is controlled by an automated screen selection program, which activates the bottom backlight and deactivates the top backlight for uni-directional screen view. Automated screen selection program activates top backlight for multi-directional screen view.

12 Claims, 8 Drawing Sheets

(56) References Cited

U.S. PATENT DOCUMENTS

| | | | | |
|---|---|---|---|---|
| 2009/0067156 | A1* | 3/2009 | Bonnett | H04N 13/0454 362/97.2 |
| 2010/0020109 | A1* | 1/2010 | Belik | G09G 3/2003 345/690 |
| 2010/0137033 | A1* | 6/2010 | Lee | G02B 6/0076 455/566 |
| 2010/0275266 | A1* | 10/2010 | Jakobson | G06F 3/14 726/26 |
| 2012/0081922 | A1* | 4/2012 | Yeh | G02B 6/0021 362/612 |
| 2014/0286044 | A1* | 9/2014 | Johnson | G02B 5/021 362/607 |
| 2016/0098700 | A1* | 4/2016 | Johnson | G06Q 20/1085 705/43 |

OTHER PUBLICATIONS

"3M Privacy and Screen Protectors", © 3M 2016, Printed Jan. 13, 2016, 5 pages, <http://solutions.3m.com/wps/portal/3M/en_US/3MScreens_NA/Protectors/Privacy/>.

"Computer monitor", Wikipedia, the free encyclopedia, last modified Nov. 23, 2015, pp. 1-4, <https://en.wikipedia.org/wiki/Computer_monitor#Additional_features>.

"Computer Screen Filters", © 3M 2016, Printed Jan. 13, 2016, 2 pages, <http://solutions.3mae.ae/wps/portal/3M/en_AE/EU-SafetySecurityProtection/Home/ProdInfo/ComputerScreenFilters/>.

"Switchable Viewing-angle LCDs", © 2015 Sharp Corporation, Printed Dec. 2, 2015, pp. 1-2, <http://www.sharp-world.com/products/device/about/lcd/veil/index.html>.

* cited by examiner

UNI-DIRECTIONAL AND MULTI-DIRECTIONAL INTERCHANGEABLE SCREEN

BACKGROUND OF THE INVENTION

The present invention relates generally to the field of directional screens, and more particularly to a uni-directional and multi-directional interchangeable screen that can be programmatically changed from uni-directional to multi-directional mode.

The increasing use of mobile devices, automated teller machines (ATMs), and credit card processing devices to view personal information has led to directional screens to protect the information and maintain confidentiality. For example, if an attacker looks over the shoulder of an unsuspecting user then the unsuspecting user's personal information may become compromised. Personal information typically used in correlation with such devices can include billing information and personal identification numbers (PINs). Directional screens allow a switchable viewing-angle that gives the user the ability to switch between a normal wide-angle display (multi-directional) and a narrow-angle display (uni-directional) that guards against unwanted viewing from the side. Uni-directional screens are narrow viewing angle screens that are used in some security conscious applications. Uni-directional filters ensure that viewers observing from a wide range of angles do not see the screen.

SUMMARY

A method for automated screen selection, the method comprising the steps of: receiving, by one or more computer processors, an indication that an application has been initiated; determining, by one or more computer processors, that viewing protection is associated with the application; and on a dual screen comprising at least two viewing angles, initiating, by one or more computer processors, a uni-directional screen view, wherein the unidirectional screen view comprises one viewing angle.

A computer program product comprising: a computer readable storage medium and program instructions stored on the computer readable storage medium, the program instructions comprising: program instructions to receive an indication that an application has been initiated; program instructions to determine that viewing protection is associated with the application; and program instructions to, on a dual screen comprising at least two viewing angles, initiate a uni-directional screen view, wherein the unidirectional screen view comprises one viewing angle.

An interchangeable dual screen system comprising: at least one screen having a top surface and a bottom surface, wherein the top surface is a viewing surface; at least one opaque micro-tube having a first end and a second end, wherein the first end is coupled to the bottom surface of the screen; at least one bottom backlight, wherein the bottom backlight is coupled to the second end of the opaque micro-tube; and at least one top backlight, wherein the top backlight is coupled to the bottom surface of the screen.

DETAILED DESCRIPTION

Certain applications require the increased security provided by uni-directional screens. However, uni-directional screens require the user to remain at a fixed angle and often to adjust the head in order to view all of the content of the screen. Furthermore, uni-directional screens consisting of a film require the user to remove the film to view the screen in multi-directional mode for applications that do not require increased security. Embodiments of the present invention provide systems and methods for a new screen that can be programmatically changed from uni-directional to multi-directional mode.

Figure 1:
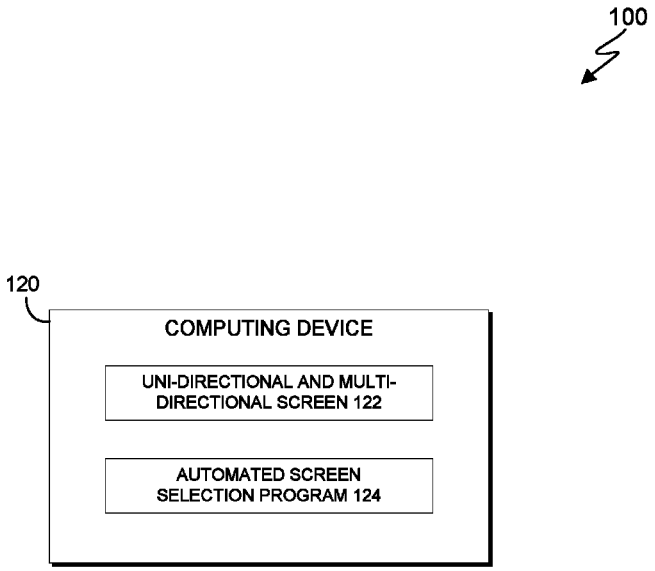
FIG. 1 is a functional block diagram illustrating a computing device, in accordance with an embodiment of the present invention.

The present invention will now be described in detail with reference to the figures. FIG. 1 is a functional block diagram illustrating a computing device, generally designated 120, in accordance with one embodiment of the present invention. FIG. 1 provides only an illustration of one implementation, and does not imply any limitations with regard to the environments in which different embodiments may be implemented. Many modifications to the depicted environment may be made by those skilled in the art without departing from the scope of the invention as recited by the claims.

Computing device 120 can be a desktop computer, laptop computer, specialized computer server, or any other computer system known in the art. In certain embodiments, computing device 120 is representative of any electronic devices, or combination of electronic devices, capable of executing machine-readable program instructions, as described in greater detail with regard to FIG. 7.

Computing device 120 comprises uni-directional and multi-directional screen 122 and automated screen selection program 124. In the exemplary embodiment, uni-directional and multi-directional screen 122 is the user interface between the user and computing device 120. Uni-directional and multi-directional screen 122 is used to prevent others from viewing personal information on computing device 120, for example, personal bank account information.

Automated screen selection program 124 includes software capable of determining whether an application requires uni-directional viewing protection and activating the appropriate directional screen. Automated screen selection program 124 is a list of instructions to be used by computing device 120 for the purpose of switching between uni-directional and multi-directional views.

Figure 2:
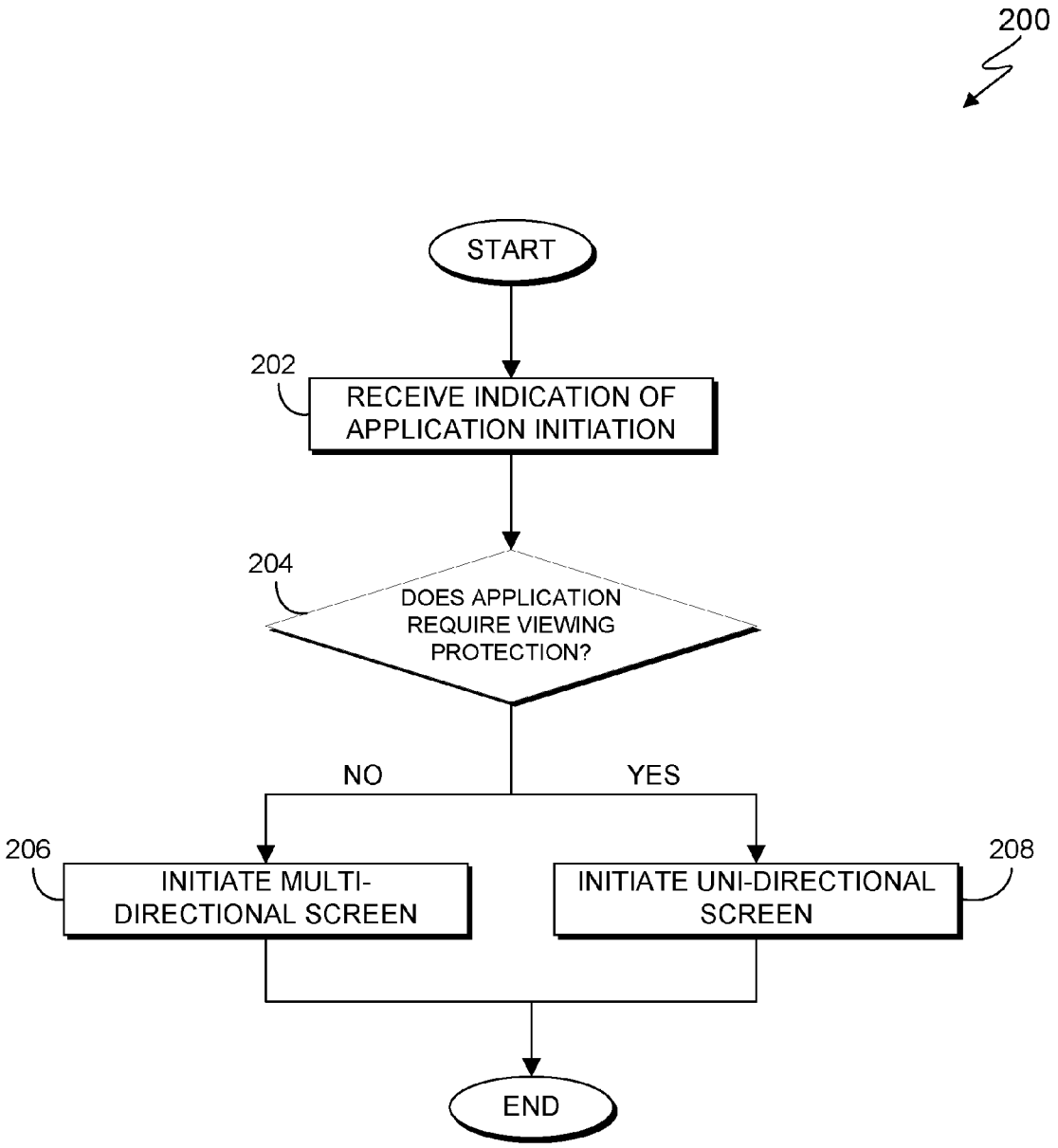
FIG. 2 is a flowchart depicting operational steps of an automated uni-directional and multi-directional screen selection program, in accordance with an embodiment of the present invention.

FIG. 2 is a flowchart, 200, depicting operational steps for determining the current active application and loading the directional screen that provides the appropriate level of protection, in accordance with an embodiment of the present invention.

In step 202, automated screen selection program 124 receives an indication that an application has been initiated.

In step 204, automated screen selection program 124 determines whether the active application requires uni-directional viewing protection. In this exemplary embodiment, automated screen selection program 124 determines that applications requiring a user password also require uni-directional viewing protection. In another embodiment, automated screen selection program 124 detects that an application containing personal information and requires uni-directional viewing protection. It should be appreciated, however, that any suitable method of determining whether an application needs viewing protection may be used. In another embodiment, the uni-directional and multi-directional screen is configured for manual screen selection by a user.

If, in step 204, automated screen selection program 124 determines that the active application does not require viewing protection, then in step 206 automated screen selection program 124 initiates multi-directional screen view. In this exemplary embodiment, multi-directional screen view is viewable at multiple angles respective to uni-directional and multi-directional screen 122 (see FIG. 4B). For example, if the user activates a sports application that does not contain any personal information, automated screen selection program 124 will activate multi-directional screen view.

If, in step 204, automated screen selection program 124 determines that the active application does require viewing protection, then in step 208 automated screen selection program 124 initiates uni-directional screen view. In this exemplary embodiment, uni-directional screen view is viewable at one angle respective to uni-directional and multi-directional screen 122 (see FIG. 4A). For example, if the user activates a banking application that requires a password, automated screen selection program 124 will activate uni-directional screen view for added protection.

Accordingly, by performing the operational steps of FIG. 2, automated screen selection program 124 determines if an application contains private information requiring view protection and activates the appropriate directional screen.

Figure 3:
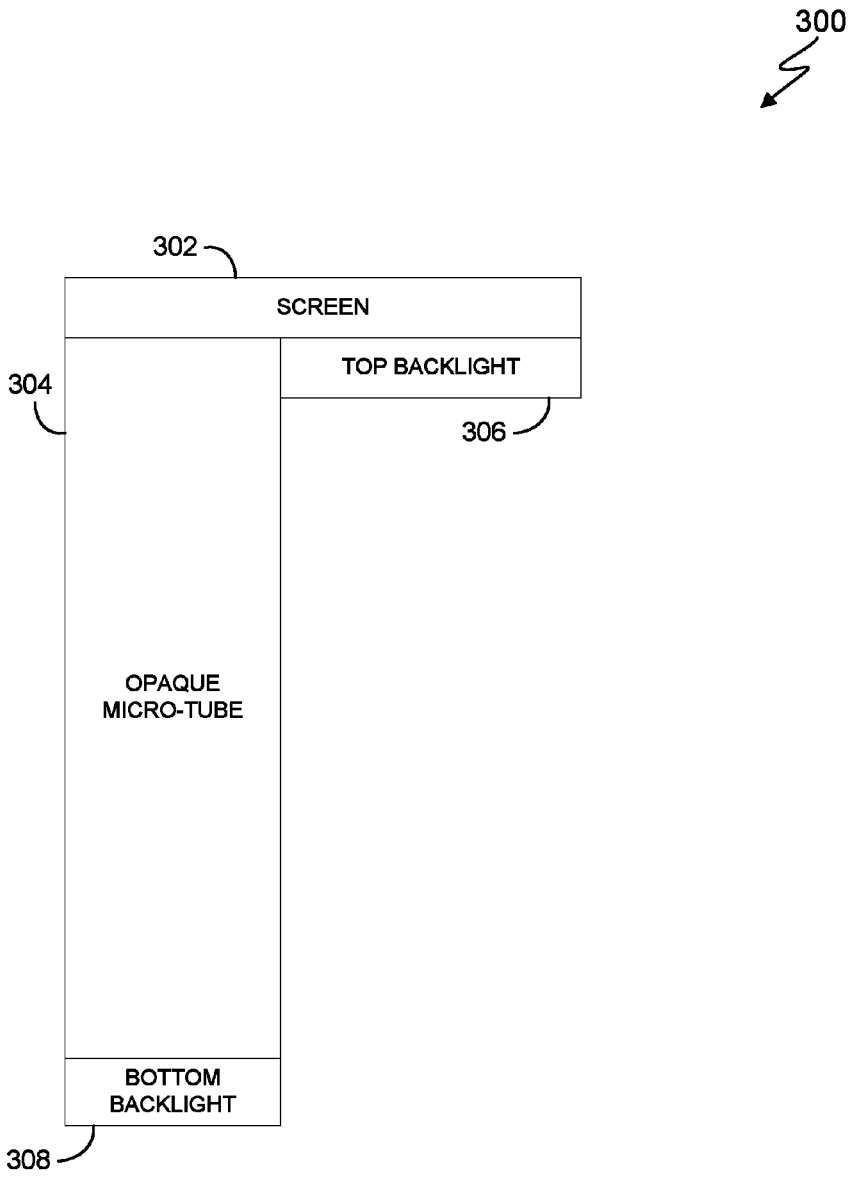
FIG. 3 is a diagram illustrating a plan view of components of a uni-directional and multi-directional screen, in accordance with an embodiment of the present invention.

FIG. 3 is a diagram illustrating a plan view of components of a uni-directional and multi-directional screen, 300, in accordance with an embodiment of the present invention.

Uni-directional and multi-directional screen 300 comprises screen 302, opaque micro-tube 304, top backlight 306, and bottom backlight 308. In this exemplary embodiment, opaque micro-tube 304 is connected to the bottom surface of screen 302. The top surface of screen 302 is the user viewing surface. Top backlight 306 is connected to the bottom surface of screen 302. Bottom backlight 308 is connected to opaque micro-tube 304. Screen 302 comprises transparent color changeable pixels, for example, a liquid-crystal display (LCD). Opaque micro-tube 304 comprises perfectly opaque walls. Below screen 302 lighting is provided by two sources: top backlight 306 and bottom backlight 308. Top backlight 306 is a light source, for example, a light-emitting diode (LED), close to screen 302 (i.e., surface LED) that provides a multi-directional viewing effect (see FIG. 4B). Bottom backlight 308 is a light source, for example, an LED, located at the bottom of a deep opaque micro-tube 304, which provides a uni-directional viewing effect (see FIG. 4A).

Figure 4A:
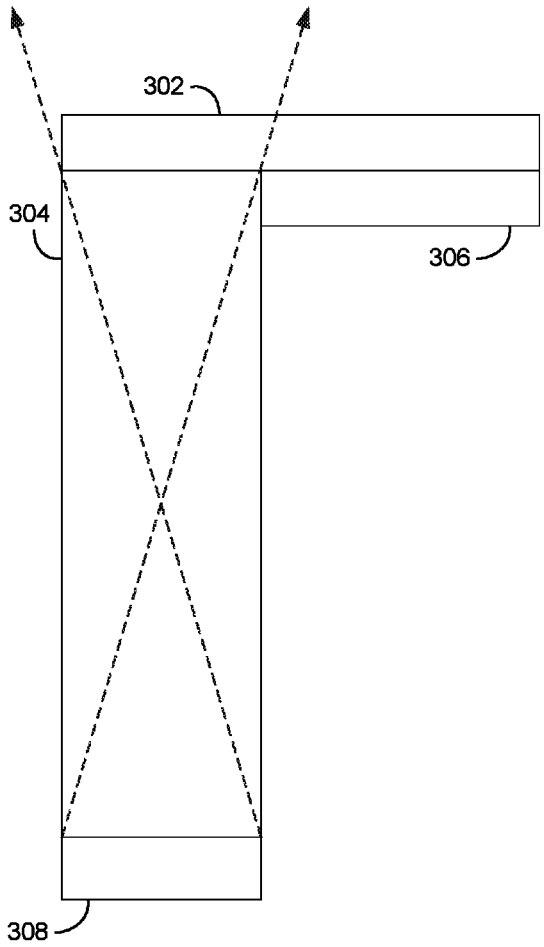
FIG. 4A is a diagram depicting an example plan view of a uni-directional and multi-directional screen in uni-directional mode, in accordance with an embodiment of the present invention.

FIG. 4A is a diagram depicting an example of a uni-directional and multi-directional screen in uni-directional mode, in accordance with an embodiment of the present invention. In uni-directional mode, only bottom backlight 308 is powered, while top backlight is inactive. Opaque micro-tube 304 allows only narrow angle light to be emitted through screen 302. As such, the user can only view screen 302 at a straight-on angle.

Figure 4B:
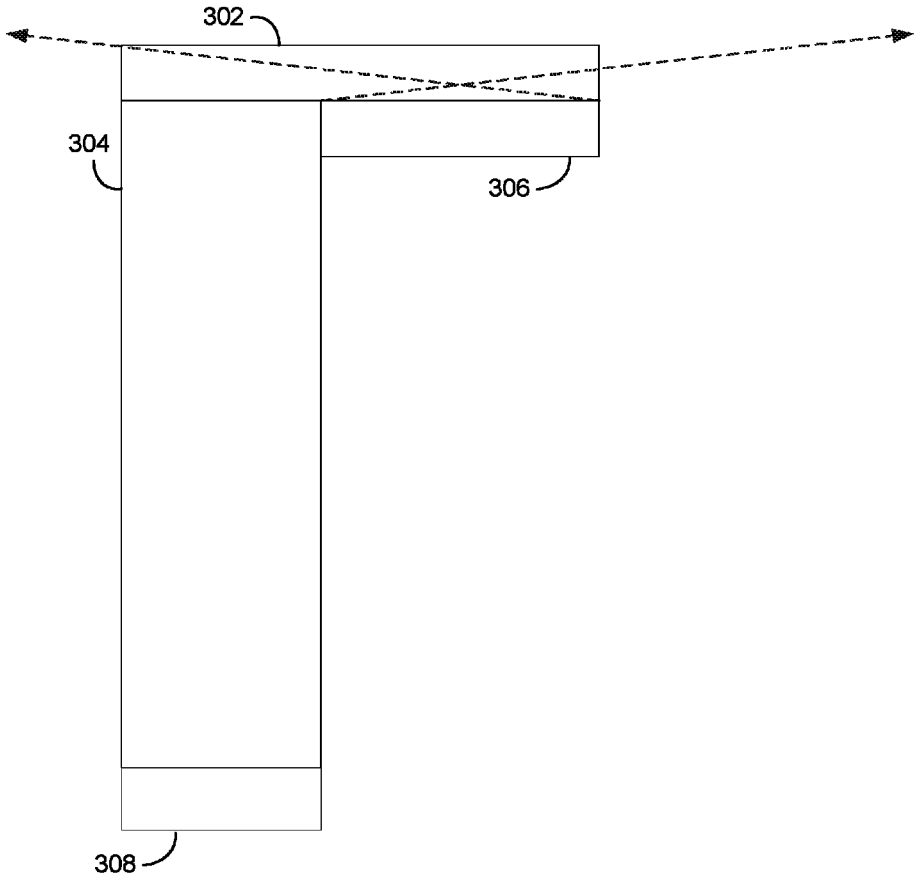
FIG. 4B is a diagram depicting an example plan view of a uni-directional and multi-directional screen in multi-directional mode, in accordance with an embodiment of the present invention.

FIG. 4B is a diagram depicting an example plan view of a uni-directional and multi-directional screen in multi-directional mode, in accordance with an embodiment of the present invention. In multi-directional mode, top backlight 306 is powered while bottom backlight 308 is inactive. Opaque micro-tube 304 does not limit the light and wide angle light is emitted through screen 302. It should be appreciated, however, that in multi-directional mode both top backlight 306 and bottom backlight 308 may be powered. As such, the user can view screen 302 from multiple angles.

Figure 5:
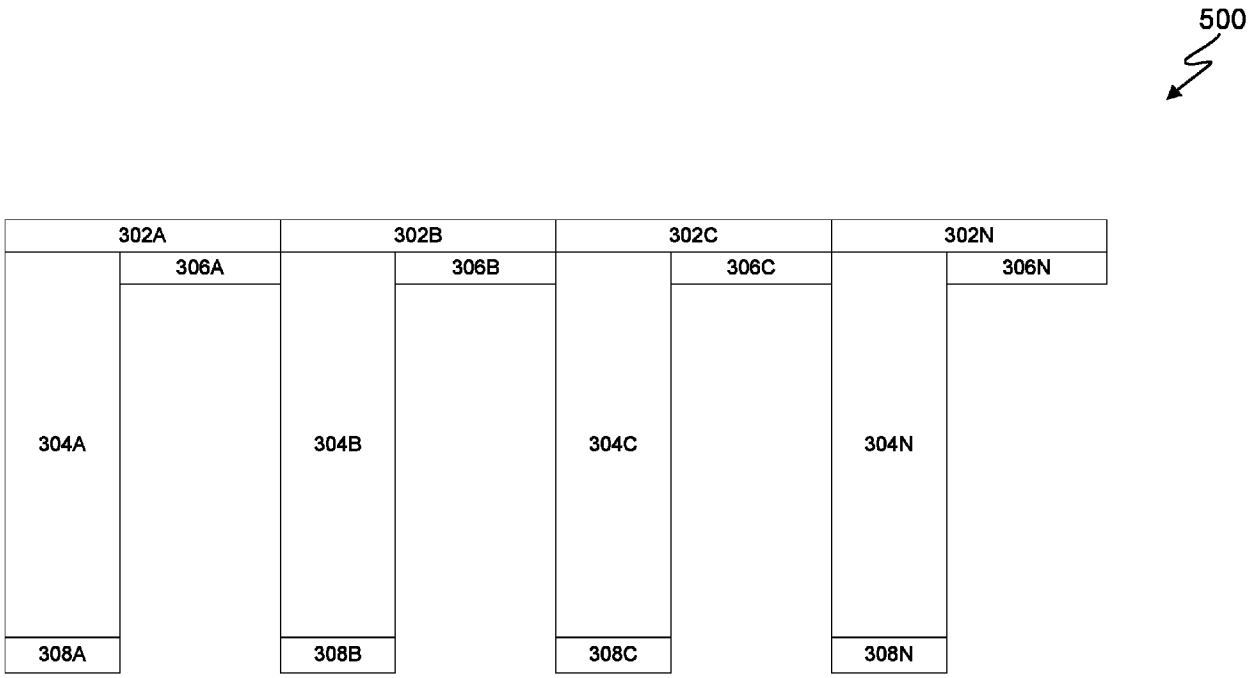
FIG. 5 is a diagram depicting an example plan view of a uni-directional and multi-directional screen, in accordance with an embodiment of the present invention.

FIG. 5 is a diagram, 500, depicting an example plan view of a uni-directional and multi-directional screen, in accordance with an embodiment of the present invention. Uni-directional and multi-directional screen consists of screens 302A-N, opaque micro-tubes 304A-N, top backlights 306A-N, and bottom backlights 308A-N. FIG. 5 shows an example of multiple uni-directional and multi-directional screens connected together.

Figure 6:
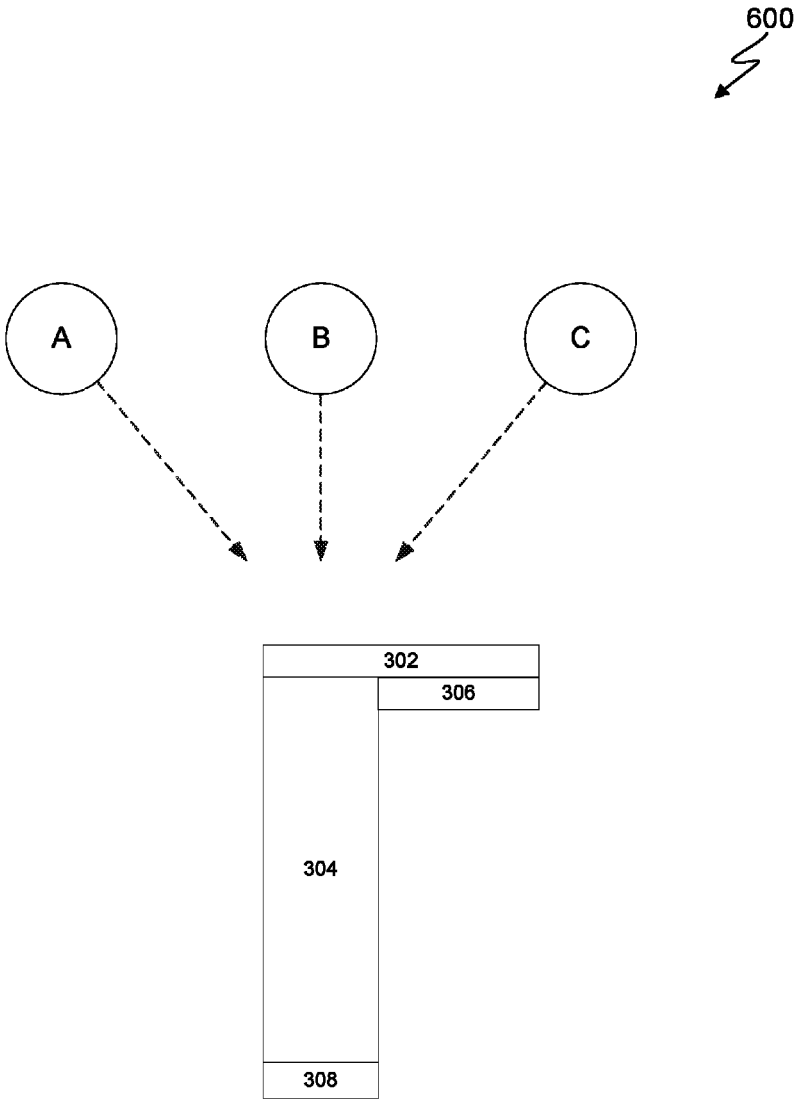
FIG. 6 is an example top view of viewing angles with respect to a uni-directional and multi-directional screen, in accordance with an embodiment of the present invention.

FIG. 6 is an example top view, 600, of viewing angles with respect to a uni-directional and multi-directional screen, in accordance with an embodiment of the present invention. In uni-directional mode, only bottom backlight 308 is powered, while top backlight is inactive. Opaque micro-tube 304 allows only narrow angle light to be emitted through screen 302. As such, the user can only view screen 302 at a straight-on angle, for example, at position B. In multi-directional mode, top backlight 306 is powered while bottom backlight 308 is inactive. Opaque micro-tube 304 does not limit the light and wide angle light is emitted through screen 302. It should be appreciated, however, that in multi-directional mode both top backlight 306 and bottom backlight 308 may be powered. As such, the user can view screen 302 from multiple angles, for example, at positions A, B, and C.

Figure 7:
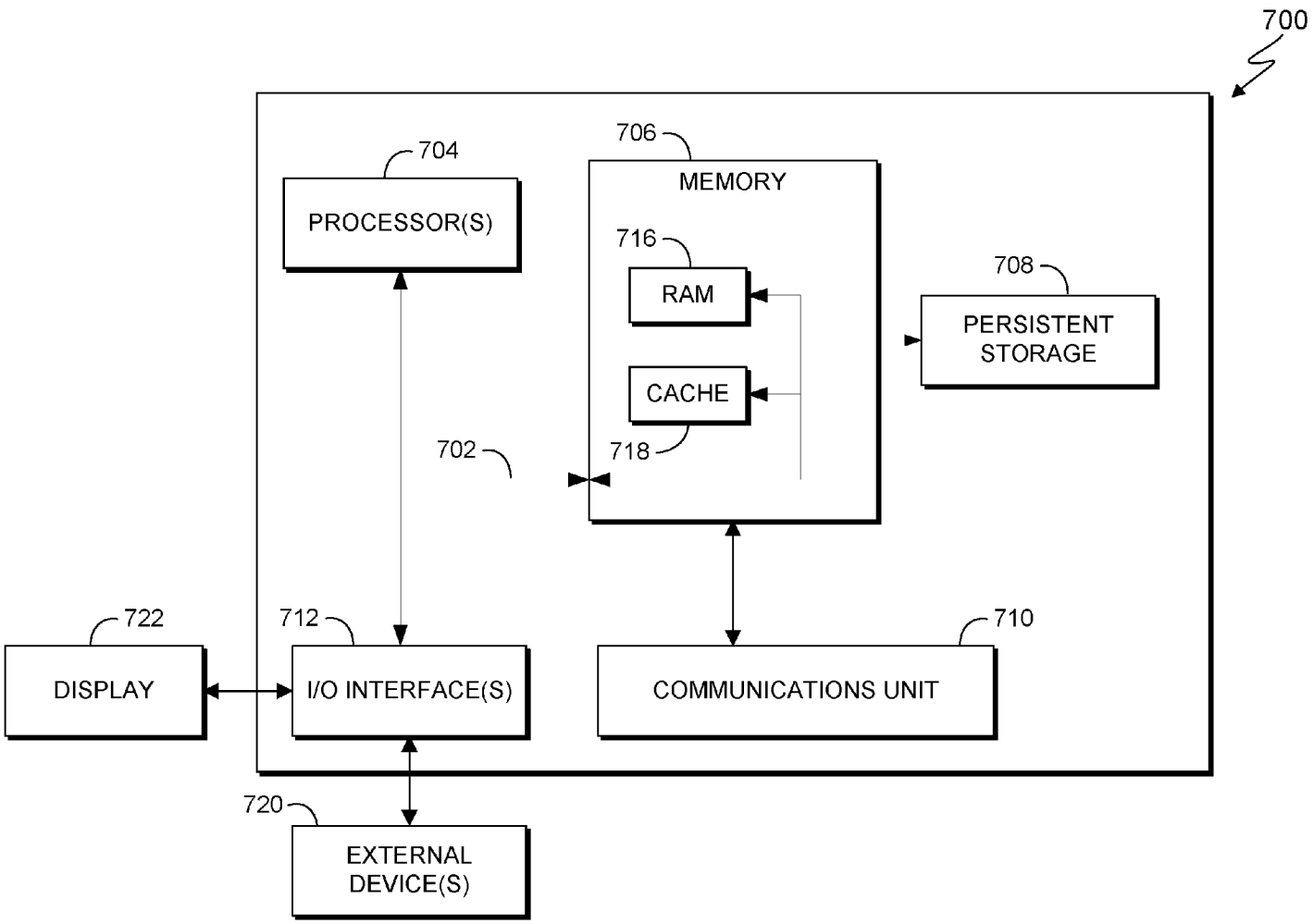
FIG. 7 is a block diagram of internal and external components of a computer system, in accordance with an embodiment of the present invention.

FIG. 7 is a block diagram of internal and external components of computing device 700, which is representative of the computing devices of FIG. 1, in accordance with an embodiment of the present invention. It should be appreciated that FIG. 7 provides only an illustration of one implementation and does not imply any limitations with regard to the environments in which different embodiments may be implemented. In general, the components illustrated in FIG. 7 are representative of any electronic device capable of executing machine-readable program instructions. Examples of computer systems, environments, and/or configurations that may be represented by the components illustrated in FIG. 7 include, but are not limited to, personal computer systems, server computer systems, thin clients, thick clients, laptop computer systems, tablet computer systems, cellular telephones (i.e., smart phones), multiprocessor systems, microprocessor-based systems, network PCs, minicomputer systems, mainframe computer systems, and distributed cloud computing environments that include any of the above systems or devices.

Computing device 700 includes communications fabric 702, which provides for communications between one or more processing units 704, memory 706, persistent storage 708, communications unit 710, and one or more input/output (I/O) interfaces 712. Communications fabric 702 can be implemented with any architecture designed for passing data and/or control information between processors (such as microprocessors, communications and network processors, etc.), system memory, peripheral devices, and any other hardware components within a system. For example, communications fabric 702 can be implemented with one or more buses.

Memory 706 and persistent storage 708 are computer readable storage media. In this embodiment, memory 706 includes random access memory (RAM) 716 and cache memory 718. In general, memory 706 can include any suitable volatile or non-volatile computer readable storage media. Software is stored in persistent storage 708 for execution and/or access by one or more of the respective processors 704 via one or more memories of memory 706.

Persistent storage 708 may include, for example, a plurality of magnetic hard disk drives. Alternatively, or in addition to magnetic hard disk drives, persistent storage 708 can include one or more solid state hard drives, semiconductor storage devices, read-only memories (ROM), erasable programmable read-only memories (EPROM), flash memories, or any other computer readable storage media that is capable of storing program instructions or digital information.

The media used by persistent storage 708 can also be removable. For example, a removable hard drive can be used for persistent storage 708. Other examples include optical and magnetic disks, thumb drives, and smart cards that are inserted into a drive for transfer onto another computer readable storage medium that is also part of persistent storage 708.

Communications unit 710 provides for communications with other computer systems or devices via a network. In this exemplary embodiment, communications unit 710 includes network adapters or interfaces such as a TCP/IP adapter cards, wireless Wi-Fi interface cards, or 3G or 4G wireless interface cards or other wired or wireless communications links. The network can comprise, for example, copper wires, optical fibers, wireless transmission, routers, firewalls, switches, gateway computers and/or edge servers. Software and data used to practice embodiments of the present invention can be downloaded to computing device 700 through communications unit 710 (i.e., via the Internet, a local area network, or other wide area network). From communications unit 710, the software and data can be loaded onto persistent storage 708.

One or more I/O interfaces 712 allow for input and output of data with other devices that may be connected to computing device 700. For example, I/O interface 712 can provide a connection to one or more external devices 720 such as a keyboard, computer mouse, touch screen, virtual keyboard, touch pad, pointing device, or other human interface devices. External devices 720 can also include portable computer readable storage media such as, for example, thumb drives, portable optical or magnetic disks, and memory cards. I/O interface 712 also connects to display 722.

Display 722 provides a mechanism to display data to a user and can be, for example, a computer monitor. Display 722 can also be an incorporated display and may function as a touch screen, such as a built-in display of a tablet computer.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the invention. The terminology used herein was chosen to best explain the principles of the embodiment, the practical application or technical improvement over technologies found in the marketplace, or to enable others of ordinary skill in the art to understand the embodiments disclosed herein.

What is claimed is:

1. A method for automated screen selection, the method comprising the steps of:

determining, by one or more computer processors, that an application contains personal information by identifying that the application requires a password to unlock features associated with the application;

responsive to determining that the application contains personal information, on a screen having two display modes, deactivating, by one or more processors of a first backlight of a backlight system, wherein the screen includes a front end and a back end, wherein the backlight system is composed of:

the first backlight having four surfaces that form an enclosure, a second backlight having four surfaces that form an enclosure, and a fixed opaque micro-tube having opposite ends, wherein:

a first surface of the first backlight is connected directly to a portion of the back end of the screen, a second surface of the first backlight is coupled to a side portion of the fixed opaque micro-tube, a first end of the fixed opaque microtube is connected directly to another portion of the back end of the screen, and a second end, opposite of the first end of the fixed opaque microtube, is connected directly to a first surface of the second backlight;

responsive to determining that the application contains personal information, on the screen, activating, by one or more processors, the second backlight; wherein:

the second backlight allows narrow angle light to be emitted from the second backlight behind the screen, to a user located in front of a viewing surface of the screen; and responsive to determining that the application does not contain person information, on a dual screen, activating, by one or more computer processors, the first backlight which allows for wide angle light to be emitted from the first backlight to the user located in front of the front end of the screen.

2. The method of claim 1, wherein the screen comprises two viewing modes, wherein the first viewing mode is a uni-directional screen view comprising one viewing angle and wherein the second viewing mode is a multi-directional screen view comprising at least two viewing angles.

3. The method of claim 1, wherein the screen is configured for manual screen selection by the user.

4. A computer program product comprising:

a computer readable storage medium and program instructions stored on the computer readable storage medium, the program instructions comprising:

program instructions to determine that an application contains personal information by identifying that the application requires a password to unlock features associated with the application;

program instructions to, responsive to determining that the application contains personal information, on a screen having two display modes, deactivate of a first backlight of a backlight system, wherein the screen includes a front end and a back end, wherein the backlight system is composed of:

the first backlight having four surfaces that form an enclosure, a second backlight having four surfaces that form an enclosure, and a fixed opaque micro-tube having opposite ends, wherein:

a first surface of the first backlight is connected directly to a portion of the back end of the screen, a second surface of the first backlight is coupled to a side portion of the fixed opaque micro-tube, a first end of the fixed opaque microtube is connected directly to another portion of the back end of the screen, and a second end, opposite of the first end of the fixed opaque microtube, is connected directly to a first surface of the second backlight;

program instructions to, responsive to determining that the application contains personal information, on the screen, activating, by one or more processors, the second backlight; wherein:

the second backlight allows narrow angle light to be emitted from the second backlight behind the screen, to a user located in front of a viewing surface of the screen; and program instructions to, responsive to determining that the application does not contain person information, on a dual screen, activate the first backlight which allows for wide angle light to be emitted from the first backlight to the user located in front of the front end of the screen.

5. The computer program product of claim 4, wherein the screen comprises two viewing modes, wherein the first viewing mode is a uni-directional screen view comprising one viewing angle and wherein the second viewing mode is a multi-directional screen view comprising at least two viewing angles.

6. The computer program product of claim 4, wherein the screen is configured for manual screen selection by the user.

7. An interchangeable screen system consisting of:

one screen having opposed first and second surfaces, wherein said first surface is a viewing surface, and wherein said second surface is opposite of said first surface;

a backlight system, operatively coupled within said screen, wherein the backlight system consisting:

one opaque micro-tube having a first end and a second opposite end, wherein said first end is coupled to a portion of said second surface of said one screen a first backlight, having four surfaces forming an enclosure, wherein a first surface of the backlight is directly coupled to another portion of said second surface of said one screen that is not coupled to said opaque micro-tube, wherein a second surface of said first backlight is coupled to a portion of said opaque micro-tube, and wherein a third surface and fourth surface of said first backlight does not connect to said opaque micro-tube; and a second backlight, having a first surface and an opposite second surface, wherein said one second backlight is directly coupled to said second end of said opaque micro-tube;

wherein said opaque micro-tube maintains a fixed position between said portion of said second surface of said one screen and said first surface of the second backlight.

8. The interchangeable screen system of claim 7, wherein said one screen comprises transparent color changeable pixels.

9. The interchangeable screen system of claim 7, wherein said first backlight is configured to be inactive and said second backlight is configured to be active to allow narrow angle light to be emitted from the second backlight coupled to said end of said opaque micro-tube, to a user located in front of the first surface of the one screen, to provide one angle of viewing in a uni-directional viewing mode.

10. The interchangeable screen system of claim 7, wherein said first backlight is configured to be active and said second backlight is configured to be inactive to allow wide angle light to be emitted from the first backlight coupled to said second surface of said one screen, to a user located in front of the first surface of the one screen, to provide at least two angles of viewing in a multi-directional viewing mode.

11. The interchangeable screen system of claim 7, wherein said first backlight is configured to be active and said second backlight is configured to be active to allow (i) wide angle light to be emitted from the first backlight coupled to said second surface of said one screen, and (ii) narrow angle light to be emitted from the second backlight coupled to said end of said opaque micro-tube, to a user located in front of the first surface of the one screen, to provide at least two angles of viewing in a multi-directional viewing mode.

12. The interchangeable screen system of claim 7, wherein said first backlight is a surface LED, and said second backlight is a light-emitting diode.

* * * * *